US005526827A

United States Patent [19]

Kubo et al.

[11] Patent Number: 5,526,827

[45] Date of Patent: Jun. 18, 1996

[54] SYSTEM FOR MONITORING THE QUANTITY OF CUT TOBACCO IN CIGARETTES

[75] Inventors: Fumio Kubo; Mikio Komori; Takehiro Suzuki; Shigemitsu Inomata, all of Tokyo, Japan

[73] Assignee: Japan Tobacco Inc., Tokyo, Japan

[21] Appl. No.: 216,856

[22] Filed: Mar. 24, 1994

[30] Foreign Application Priority Data

Mar. 29, 1993 [JP] Japan ..... 5-070279

[51] Int. Cl.[6] ..... A24C 5/60

[52] U.S. Cl. ..... 131/280; 131/906; 131/908

[58] Field of Search ..... 131/280, 84.1, 131/908, 906

[56] References Cited

U.S. PATENT DOCUMENTS

| | | | |
|---|---|---|---|
| 3,604,429 | 9/1971 | DeWitt | 131/906 X |
| 3,604,430 | 9/1971 | Norwich et al. | 131/906 X |
| 3,738,376 | 6/1973 | Labbe et al. | 131/906 X |
| 3,742,795 | 7/1973 | Lipcon et al. | 131/906 X |
| 4,037,608 | 7/1977 | Wahle | 131/906 X |

*Primary Examiner*—Jennifer Bahr
*Attorney, Agent, or Firm*—Birch, Stewart, Kolasch & Birch

[57] ABSTRACT

A monitoring system comprises an inspection device incorporated in a cigarette manufacturing machine and a server computer connected to the inspection device by means of a communication line. The inspection device includes a measuring circuit for continuously calculating the fill of the cut tobacco in each of a given number of divisions of each cigarette in accordance with a detection signal from a density sensor, an enrollment control section for repeatedly storing calculation data from the measuring circuit in a quantity corresponding to a predetermined number of cigarettes at a time, and a CPU for computing average calculation data for each division of each cigarette in accordance with the stored calculation data. The server computer originates quality data for the cigarettes in accordance with the average calculation data and displays the quality data on a CRT.

7 Claims, 14 Drawing Sheets

SYSTEM FOR MONITORING THE QUANTITY OF CUT TOBACCO IN CIGARETTES

BACKGROUND OF THE INVENTION

1. Field of the Invention

The present invention relates to a monitor system adapted for use in the control of the quantity of cut tobacco in cigarettes during the manufacture of the cigarettes.

2. Description of the Related Art

According to a cigarette manufacturing machine, as is generally known, cut tobacco is first fed onto a paper web traveling in one direction, and is then wrapped in the web, whereupon a continuous cigarette rod is formed. Thereafter, the formed cigarette rod is cut into individual cigarettes with a predetermined length.

Since each cigarette has opposite cut ends, the cut tobacco may possibly fall off from the cut ends.

In order to prevent the cut tobacco from falling off, the quantity of cut tobacco in the cut end portions of each cigarette is made larger than that in any other portion. Thus, the cigarette rod has high-density portions with an increased cut tobacco fill arranged at intervals equivalent to the length of each cigarette, and is cut in the center of each high-density portion to form individual cigarettes.

The cigarette manufacturing machine is provided with a pair of trimming disks for forming the high-density portions in the cigarette rod to be prepared. These trimming disks are arranged in rolling contact with each other right under an endless tobacco band, and are rotated in opposite directions. As the tobacco band travels, a layer of the cut tobacco formed on the lower surface of the band is fed toward the paper web, as is conventionally known.

Pockets are arranged at regular intervals on the peripheral edge portion of each trimming disk. While the trimming disks are rotating, each pocket of one disk and its corresponding pocket of the other disk cyclically meet each other right under the tobacco band.

The primary function of the trimming disks is to scrape off a surplus of the cut tobacco in the tobacco layer on the tobacco band by rotating, thereby adjusting the thickness of the cut tobacco layer on the tobacco band, that is, the tobacco supply from the tobacco band to the paper web.

If the pockets are formed on the trimming disks in the aforesaid manner, however, the thickness of the cut tobacco layer increases in proportion to the capacity of the pockets. Accordingly, the supply of the cut tobacco fed onto the paper web increases cyclically, so that the cigarette rod is formed having the high-density portions.

In order to cut the cigarette rod accurately in the center of each high-density portion, the rotational phases of the pockets of the trimming disks must be adjusted accurately to the cutting timing of cigarette rod.

If the peripheral speed of the trimming disks varies, however, the cigarette manufacturing machine is disabled from cutting the cigarette rod accurately in the center of each high-density portion, even though the traveling speed of the paper web or the cigarette rod is fixed.

As a result, the cut end portions of each cigarette are packed insufficiently with the cut tobacco, so that the quality of the cigarettes is poor.

It is necessary, therefore, to check the cigarette rod to see if it is cut accurately in the center of each high-density portion, during the operation of the cigarette manufacturing machine.

This inspection may be conducted by utilizing, for example, a density sensor for continuously detecting the filling density of the cut tobacco in the cigarette rod. Usually, this density sensor is used to adjust the thickness of the cut tobacco layer formed on the tobacco band, that is, the distance between each trimming disk and the tobacco band.

If an oscilloscope is connected to the density sensor through a measuring device at the time of the inspection, and if the cutting timing for the cigarette rod is applied to the input of the measuring device, however, the filling state of the cut tobacco in each cigarette can be displayed on the oscilloscope.

More specifically, the measuring device integrates detection signals from the density sensor for a given period of time, thereby continuously measuring the fill of the cut tobacco in, e.g., 20 equal divisions of each cigarette, and displays the resulting measurement data and the cutting timing superposed on the oscilloscope. Accordingly, an operator can determine, by a waveform displayed on the oscilloscope, whether or not the cigarette rod is cut accurately in the center of each high-density portion.

According to the measuring device described above, however, the measurement data for each cigarette are so few that it is hard to seize the filling state of the cut tobacco in detail.

The measuring device measures the data for the fill of the cut tobacco on the assumption that the traveling speed of the cigarette rod is fixed. If the speed of the rod is changed for, e.g., production control, therefore, the measurement data lack in accuracy. In this case, the measuring device should be adjusted according to the traveling speed of the cigarette rod. This adjustment is not easy, however, requiring expert knowledge.

Moreover, the measuring device and the oscilloscope must be connected to each other by means of an exclusive cable with every inspection, so that the inspection work is not easy after all.

In order to make a hard copy of the waveform displayed on the oscilloscope, furthermore, the picture on the scope must be photographed, thus complicating totalization of data for quality control.

SUMMARY OF THE INVENTION

The object of the present invention is to provide a monitor system capable of accurately seizing the distribution of the fill of cut tobacco in manufactured cigarettes on a real-time basis, and adapted for use in stabilizing the quality of the cigarettes and totalizing data for quality control.

The above object is achieved by a monitor system according to the present invention, which comprises: detecting means for continuously detecting the filling density of cut tobacco in a cigarette rod and outputting a detection signal while the cigarette rod is traveling; calculating means for continuously calculating the fill of the cut tobacco in each of a predetermined number of equal divisions of a region of the cigarette rod which corresponds to each cigarette, in accordance with the detection signal from the detecting means, and outputting calculation data; data storage means for repeatedly enrolling the calculation data from the calculating means in a quantity corresponding to a predetermined number of cigarettes at a time; arithmetic means for computing average calculation data for each division of the manufactured cigarettes in accordance with the calculation data enrolled by the data storage means and outputting the result of the computation; data originating means for receiving the computation result and originating quality data for the cut tobacco fill for each manufactured cigarette in accordance with the received computation result; and display means for displaying the originated quality data.

According to the monitor system described above, the fill of the cut tobacco in each cigarette is continually detected during the manufacture of the cigarettes, so that an operator of the cigarette manufacturing machine can seize the quality of the cigarettes on a real-time basis.

More specifically, the calculating means calculates the fill of the cut tobacco in each of a predetermined number of equal divisions of each cigarette, and the resulting calculation data are stored in the data storage means. The arithmetic means computes the averages of the calculation data for the individual divisions of a predetermined number of cigarettes, thereby continually providing the computation result.

If the average calculation data for the individual divisions of each cigarette are provided at all times, the data originating means can originate the quality data based on the average calculation data on a real-time basis, and display the quality data on the display means, such as a CRT display or printer.

Thus, the operator, whether highly skilled or not, can easily quickly examine the quality of the cigarettes being manufactured, that is, the cut tobacco fill, in accordance with the quality data displayed on the display means, thereby effecting quality control for the cigarettes with ease. If the display means is a printer, hard copies of the quality data can be obtained easily. By accumulating the quality data, moreover, the quality data can be controlled for each day or month.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
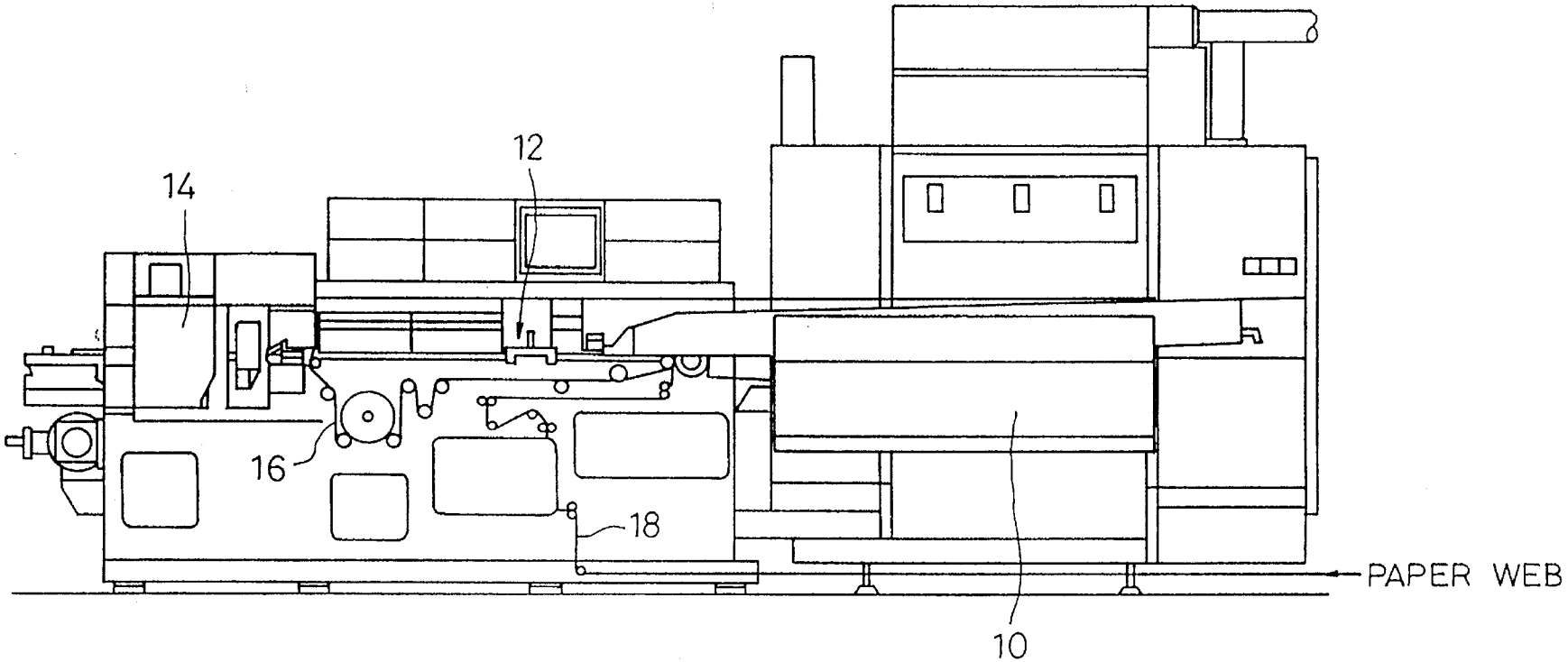
FIG. 1 is a front view schematically showing a cigarette manufacturing machine.
Figure 2:
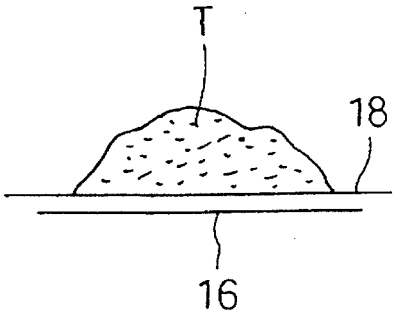
FIG. 2 is a view showing one step in a cigarette rod forming processes.
Figure 3:
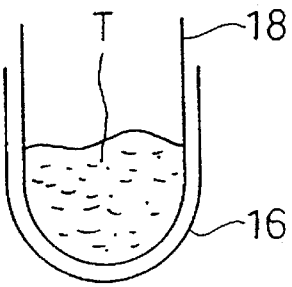
FIGS. 3, 4 and 5 are views showing the other cigarette rod forming processes in succession.
Figure 4:
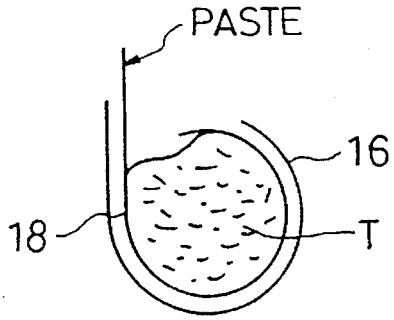
Figure 5:
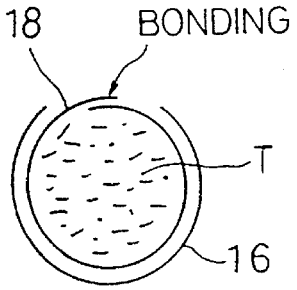

A cigarette manufacturing machine shown in FIG. 1 comprises a supply section 10, a forming section 12, and a cutting section 14, in a broad way.

The supply section 10 continuously supplies cut tobacco to the forming section 12. The forming section 12 forms a continuous cigarette rod TR in a manner such that the cut tobacco received by a paper web 18 traveling in one direction is wrapped in the web.

More specifically, the cigarette rod TR is formed in the forming section 12 in the processes shown in FIGS. 2 to 5 in succession.

Figure 6:
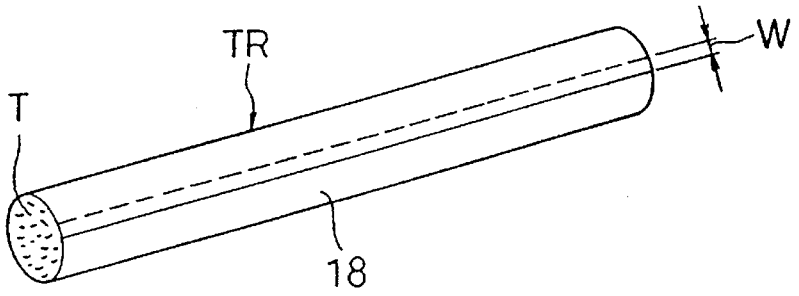
FIG. 6 is a perspective view showing part of a formed cigarette rod.

In the forming section 12, the paper web 18 travels together with an endless garniture tape 16. When the cut tobacco T is fed from the supply section 10 onto the paper web 18 (see FIG. 2), the traveling web 18, along with the garniture tape 16, is bent into the shape of a U, and wraps the cut tobacco T therein from below (see FIG. 3). After the U-shaped paper web 18 and garniture tape 16 are curved in a circular arc in a manner such that one side edge of the web 18 wraps the cut tobacco T from above, paste is applied to the other side edge of the web 18 (see FIG. 4). When the other side edge of the web 18 is curved in a circular arc in like manner so as to wrap the cut tobacco T from above, thereafter, the opposite side edges of the paper web 18 are lapped and bonded to each other (see FIG. 5). Thereupon, the continuous cigarette rod TR (see FIG. 6) is formed. In FIG. 6, symbol W designates the lap width of the paper web 18.

As the formed cigarette rod TR passes a pair of driers of the forming section 12, its pasted portion is dried, and the rod TR is delivered from the forming section 12 to the cutting section 14. In the cutting section 14, the received cigarette rod is cut into individual cigarettes.

More specifically, high-density portions with an increased cut tobacco fill have been formed in the cigarette rod TR, and the rod TR is cut in the center of each high-density portion. Thus, both cut end portions of each cigarette are packed close with the cut tobacco T so that the cut tobacco is prevented from falling off from the cut ends.

In order to form the high-density portions in the cigarette rod TR, the supply of the cut tobacco T from the supply section 10 to the paper web 18 is increased intermittently.

Figure 7:
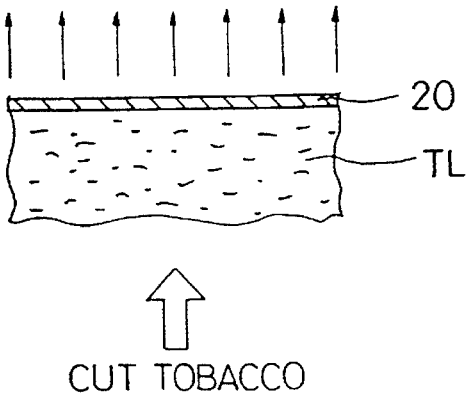
FIG. 7 is a view showing cut tobacco sucked to a tobacco band in a supply section of the manufacturing machine of FIG. 1.

The supply section 10 includes an endless tobacco band 20 and a pair of trimming disks 22. As the tobacco band 20 travels, a cut tobacco layer TL formed on the lower surface of the band 20, as shown in FIG. 7, is transported to the forming section 12.

Figure 8:
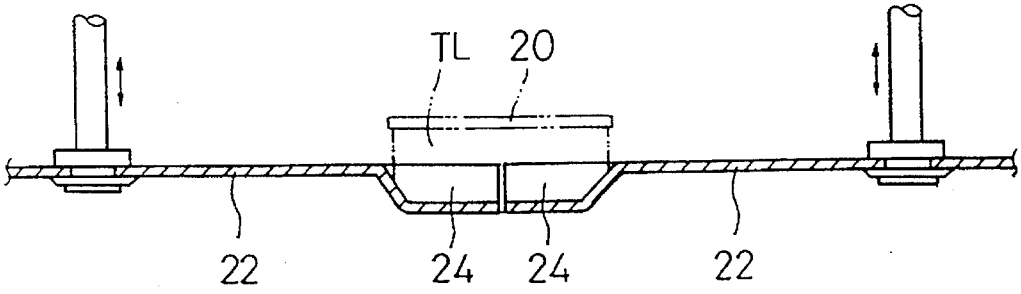
FIG. 8 is a sectional view showing part of a pair of trimming disks in the supply section.

As the tobacco band 20 passes the pair of trimming disks 22 in this process of transportation, as shown in FIG. 8, a surplus of the cut tobacco in the tobacco layer TL is scraped off by the rotating disks 22, whereby the thickness of the layer TL is adjusted.

As the trimming disks 22 are moved up and down in the directions of the arrows in FIG. 8 so that the distance between each disk 22 and the tobacco band 20 changes, the thickness of the cut tobacco layer TL is adjusted.

Each trimming disk 22 has a plurality of pockets 24 arranged at regular intervals on its peripheral edge portion. Each pocket 24 of one trimming disk 22 and its corresponding pocket 24 of the other trimming disk 22 cyclically meet each other right under the tobacco band 20.

Figure 9:
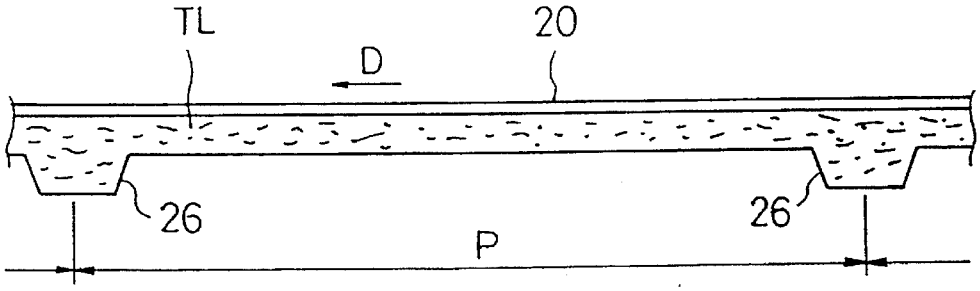
FIG. 9 is a view showing variations of a cut tobacco layer on the tobacco band.

As the cut tobacco layer TL, along with the tobacco band 20 passes the pair of trimming disks 22, therefore, specific portions 26 with increased thickness are formed on the layer TL so as to be arranged at predetermined intervals P, as shown in FIG. 9. Each interval P is equal to the length of each cigarette.

Figure 10:
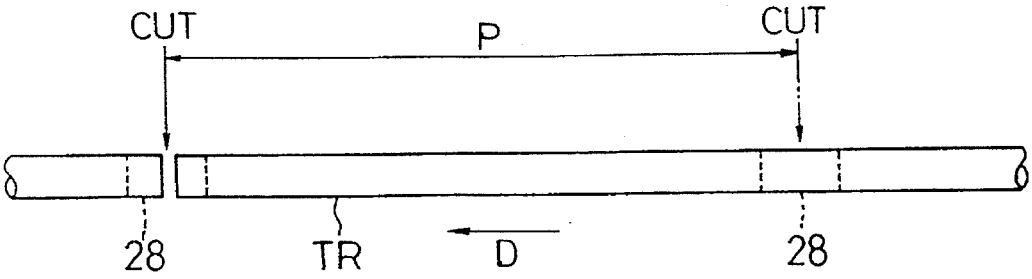
FIG. 10 is a view showing the way the cigarette rod is cut in its high-density portions.

When the cut tobacco layer TL is fed from the tobacco band 20 onto the paper web 18 in the forming section 12, thereafter, the supply of the cut tobacco T to the web 18 increases cyclically. Consequently, as shown in FIG. 10, the cigarette rod TR is formed having a high-density portion 28 for each interval P. The portions 28 correspond individually to the specific portions 26.

In FIGS. 9 and 10, arrow D indicates the traveling direction of the tobacco band 20 or the cigarette rod TR. In the cutting section 14, the formed cigarette rod TR is cut with every interval P, that is, in the center of each high-density portion 28, as mentioned before.

In this embodiment, the interval P is twice as long as each cigarette portion which is used in a filter cigarette as a final product.

Figure 12:
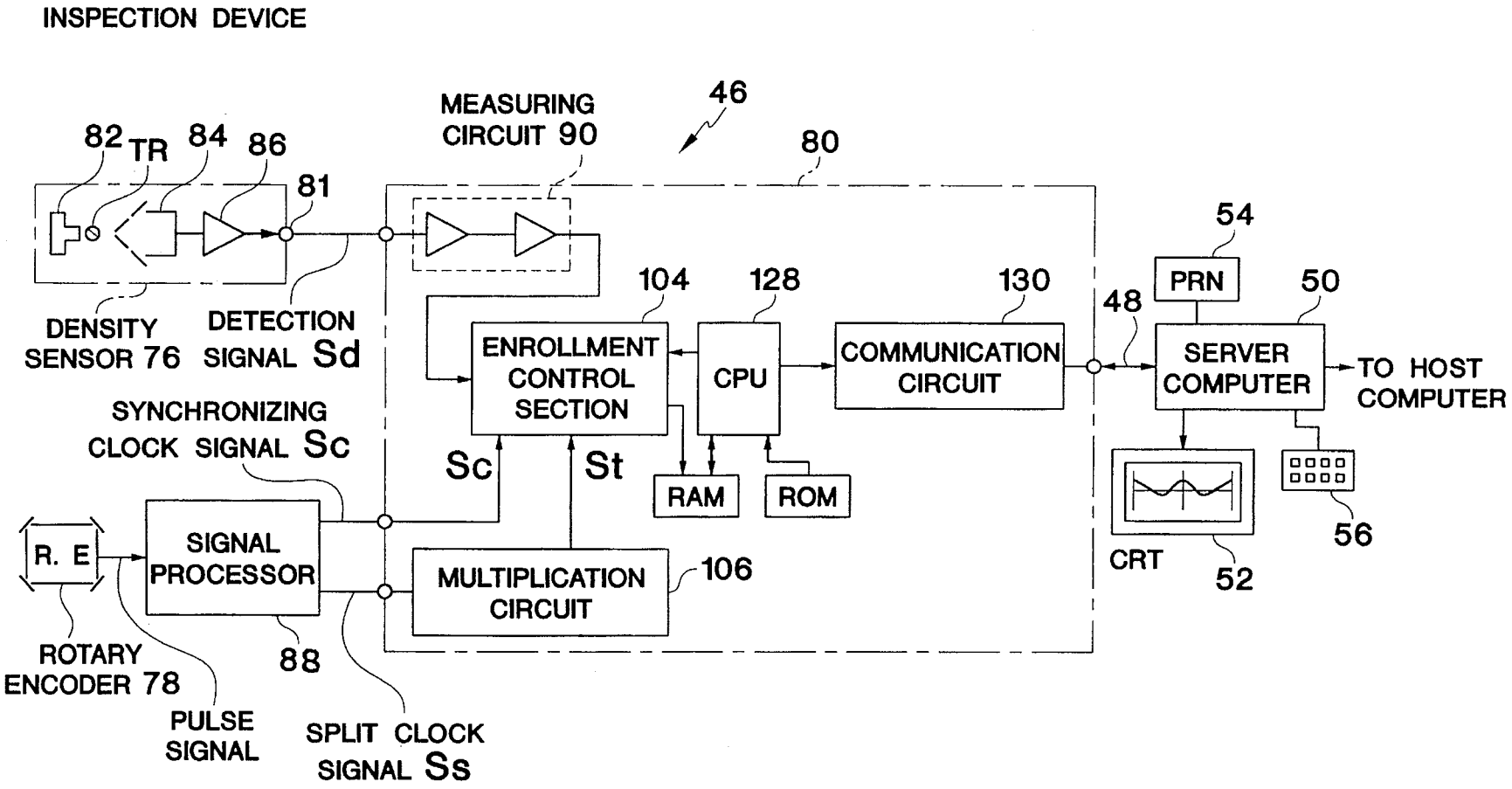
FIG. 12 is a block diagram showing an inspection device of FIG. 11.

The cigarette manufacturing machine incorporates various control devices and an inspection device (not shown in FIG. 1) which are used for the manufacture of cigarettes. FIG. 12 shows an example of an arrangement of these devices.

Figure 11:
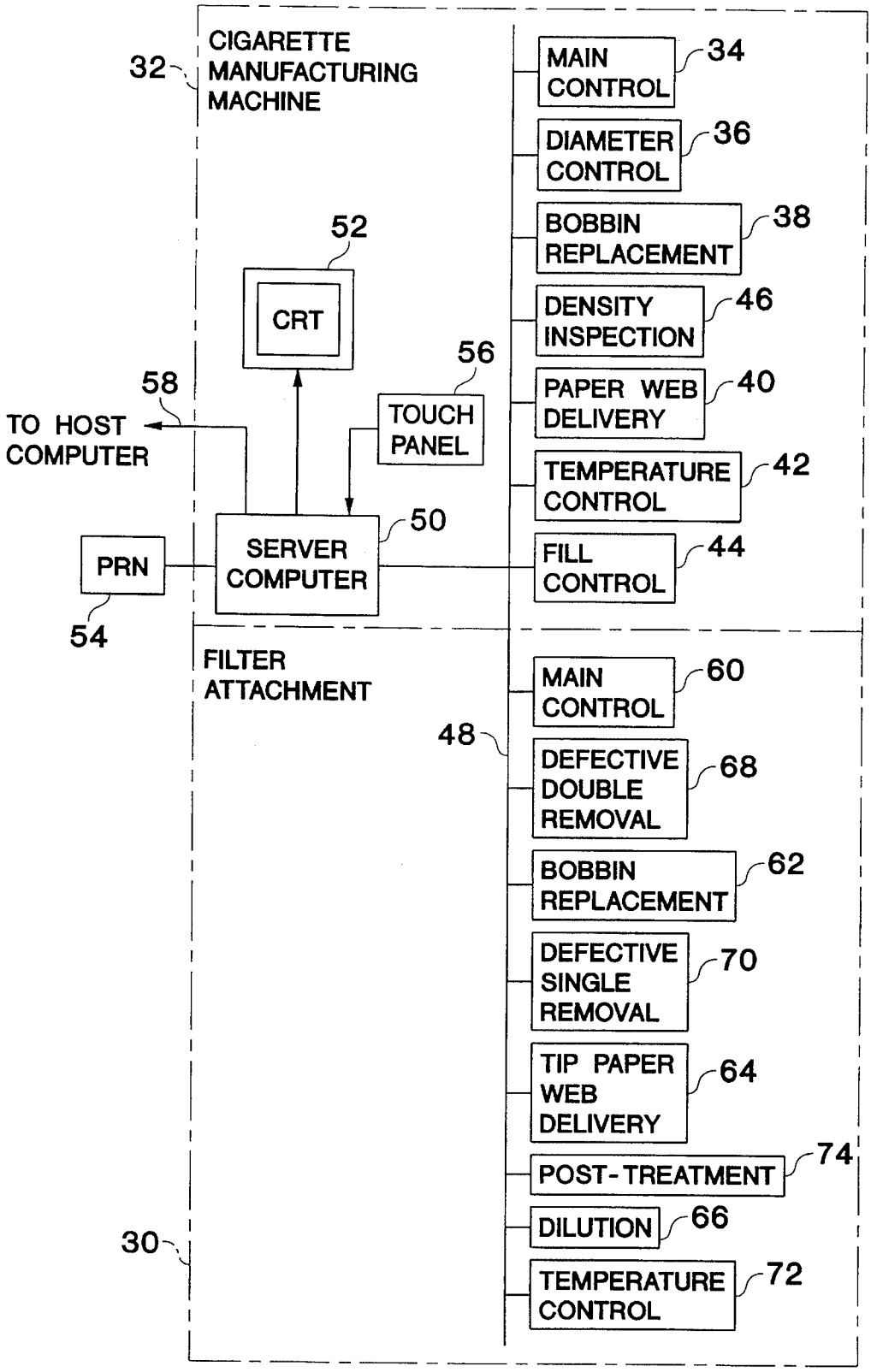
FIG. 11 is a schematic view showing various devices in the manufacturing machine and a filter attachment connected to a common server computer by means of a communication line.

In FIG. 11, one block 32, out of a pair of blocks surrounded by dashed lines, represents the cigarette manufacturing machine, while the other block 30 represents a filter attachment.

The cigarette manufacturing machine 32 is provided with a main control device 34 for controlling the operation of the manufacturing machine itself, a device 36 for controlling the diameter of cigarette rod TR to be formed, a device 38 for controlling the replacement of a bobbin for the paper web 18, and a device 40 for controlling the delivery of the paper web 18. The manufacturing machine 32 is further provided with a device 42 for controlling the temperatures of various parts of the machine, a device 44 for controlling the quantity of the cut tobacco to be filled into the cigarette rod TR, a device 46 for inspecting the formed rod TR for the distribution of the fill of the tobacco therein, etc.

These devices 34, 36, 38, 40, 42, 44 and 46 are connected to a server computer 50 by means of a communication line 48, and can send information on their control or inspection to the computer 50, automatically or in response to request commands from the computer 50.

The server computer 50, which is formed of a so-called workstation, is connected with a CRT 52, a printer 54, and a touch panel 56. Also, the computer 50 is further connected to a host computer by means of a communication line 58.

The filter attachment is a machine which is used to attach filters to the cigarettes manufactured by means of the cigarette manufacturing machine. More specifically, when the individual cigarettes are supplied to the filter attachment, they are transported to a rolling section. In this process of transportation, each cigarette is first cut into two equal parts or a pair of cigarette portions, and thereafter, a filter plug is interposed between the cigarette portions. When these two cigarette portions and the filter plug reach the rolling section, a tip paper piece is wound around them in the rolling section, whereupon a double filter cigarette is formed. After this, the double filter cigarette is further cut into two equal parts or two regular or single filter cigarettes as final products.

Tip paper pieces supplied to the rolling section can be obtained by cutting a tip paper web into equal parts with a predetermined length.

The filter attachment also incorporates various control devices for controlling its operation and an inspection device. These devices include, for example, a main control device 60 for controlling the operation of the filter attachment itself, a device 62 for controlling the replacement of a bobbin for the tip paper web, a device 64 for controlling the delivery of the tip paper web, and a device 66 for inspecting each filter cigarette for dilution (degree of dilution of smoke). The devices further include a device 68 for removing defective double filter cigarettes, if any, a device 70 for removing defective single filter cigarettes as final products, if any, a device 72 for controlling the temperatures of various parts of the filter attachment, a device 74 for controlling the post-treatment of the finished single filter cigarettes, etc.

These devices 60, 62, 64, 66, 68, 70, 72 and 74 are also connected to the server computer 50 by means of the communication line 48, and can send information on their control or inspection to the computer 50, automatically or in response to request commands from the computer 50.

FIG. 12 illustrates the details of the inspection device 46 on the manufacturing-machine side for examining the distribution of the cut tobacco fill.

The inspection device 46 comprises a density sensor 76, a rotary encoder 78, and a processing card 80, in a broad way.

The density sensor 76 may be of a radiation type, such as the one described in Japanese Pat. Appln. KOKOKU Publication No. 57-9353. As a formed cigarette rod TR passes the density sensor 76, therefore, the sensor 76 continuously delivers, from its output terminal 81, a detection signal Sd indicative of the filling density of the cut tobacco T in the cigarette rod TR. The density sensor 76 can be located in the course of travel of the cigarette rod TR, e.g., in the cutting section 14. In FIG. 12, reference numerals 82, 84 and 86 denote a source of radiation, an ion box, and an operational amplifier, respectively, in a block for the density sensor 76 surrounded by dashed line.

The rotary encoder 78 is used to detect the speed of operating speed of the cigarette manufacturing machine. More specifically, the encoder 78 is mounted on a rotating shaft of a driving drum for running the garniture tape 16. Thus, the encoder 78 generates a pulse signal proportional to the traveling speed of the paper web 18 or the rod speed of the formed cigarette rod TR, and this pulse signal is applied to a signal processing circuit 88.

In response to the pulse signal, the signal processing circuit 88 generates a synchronizing clock signal Sc synchronized with the cutting timing for the cigarette rod TR. In response to the pulse signal, moreover, the circuit 88 generates a split clock signal Ss having 30 pulses while the cigarette rod TR advances for a distance equivalent to the length of one cigarette.

Figure 13:
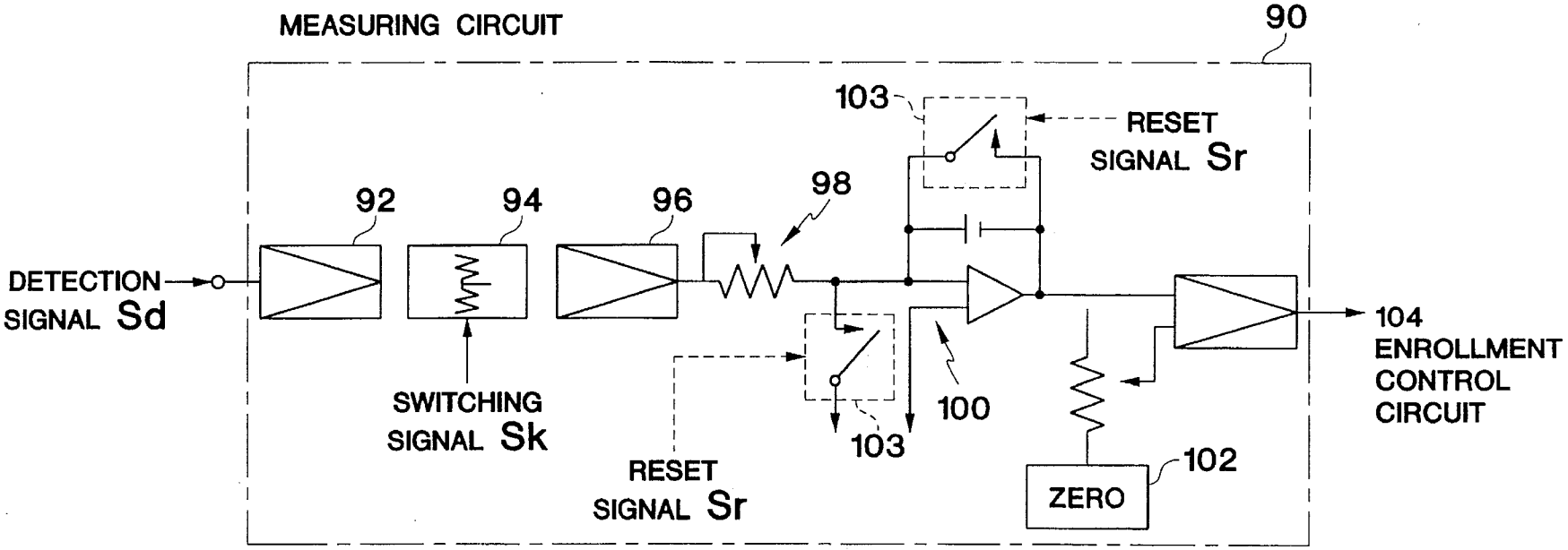
FIG. 13 is a block diagram showing a measuring circuit of FIG. 12.

The detection signal Sd from the density sensor 76 is supplied to an analog processing circuit of the processing card 80, that is, a measuring circuit 90 for measuring the cut tobacco fill. FIG. 13 illustrates the details of the measuring circuit 90. First, the detection signal Sd from the density sensor 76 is applied to the input of an attenuator 94 through a buffer amplifier 92. The attenuator 94 is designed so that its attenuation ratio can be changed when a switching signal Sk is received. The attenuation ratio is settled depending only on the rod speed of the cigarette rod TR. The switching signal Sk is generated in accordance with the pulse signal from the rotary encoder 78 or by means of a manual switch.

The output of the attenuator 94 is supplied to an integrator 100 through a buffer amplifier 96 and a span adjuster 98, and is integrated for a given period of time by the integrator 100. The integrator 100 generates a fill signal Sw indicative of the result of the integration or the cut tobacco fill. The fill signal Sw is supplied from the integrator 100 to an enrollment control section 104 through a zero adjuster 102.

The integrator 100 includes a pair of switches 103, which short their respective integrating capacitors and inputs on receiving a reset signal Sr. Thus, the reset time of the integrator 100 is settled depending on the reset signal Sr, which will be described later.

On the other hand, the synchronizing clock signal Sc from the processing circuit 88 is applied to an input of the enrollment control section 104. The split clock signal Sc is also applied to an input of the enrollment control section 104 through a multiplication circuit 106. Thus, the split clock signal Ss is supplied as a multiplied sampling clock signal St to the control section 104 by the multiplication circuit 106.

Figure 14:
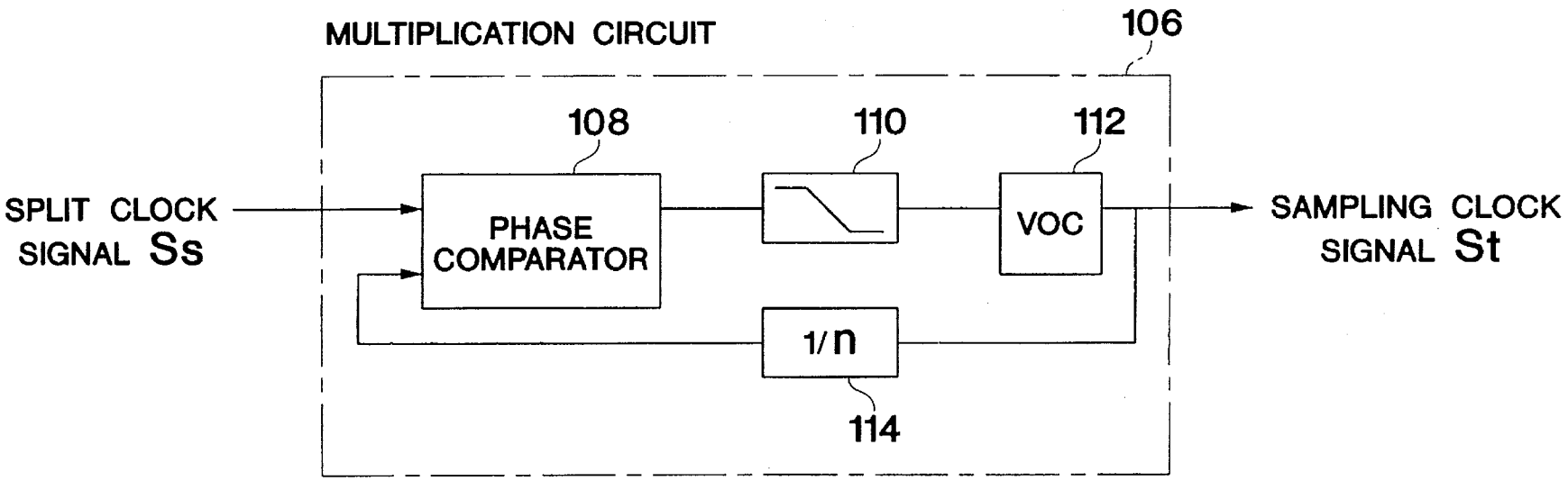
FIG. 14 is a block diagram showing a multiplication circuit of FIG. 12.

As shown in FIG. 14, the multiplication circuit 106 includes a phase comparator 108 to be supplied with the split clock signal Ss, a voltage control oscillator (VCO) 112 which receives the output of the comparator 108 through a loop filter 110, and a frequency divider 114 which returns the output of the VCO 112 to the comparator 108. Thus, the output of the VCO 112 or the sampling clock signal St can be given by $$St = n \times Ss,$$

where n is an integer such that 1/n represents the dividing ratio of the frequency divider 114.

Figure 15A:
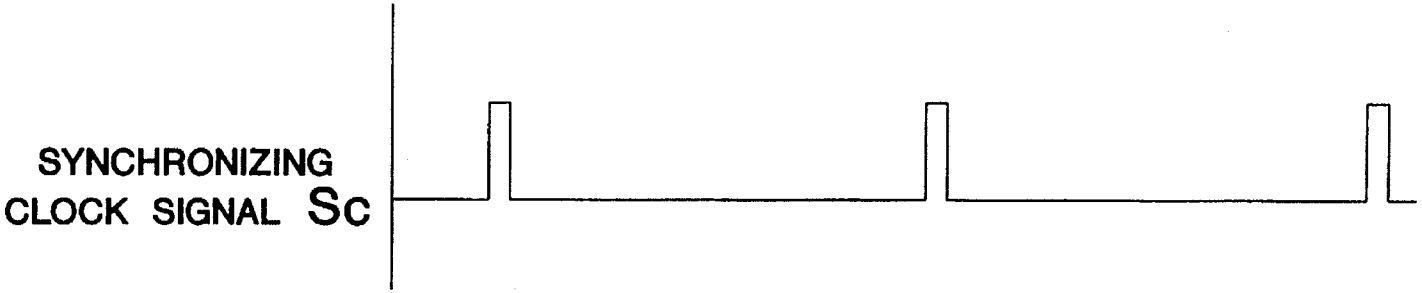
FIGS. 15A and 15B are graphs showing the waveform of a sampling clock signal delivered from the multiplication circuit of FIG. 14, along with a synchronizing clock signal.
Figure 15B:
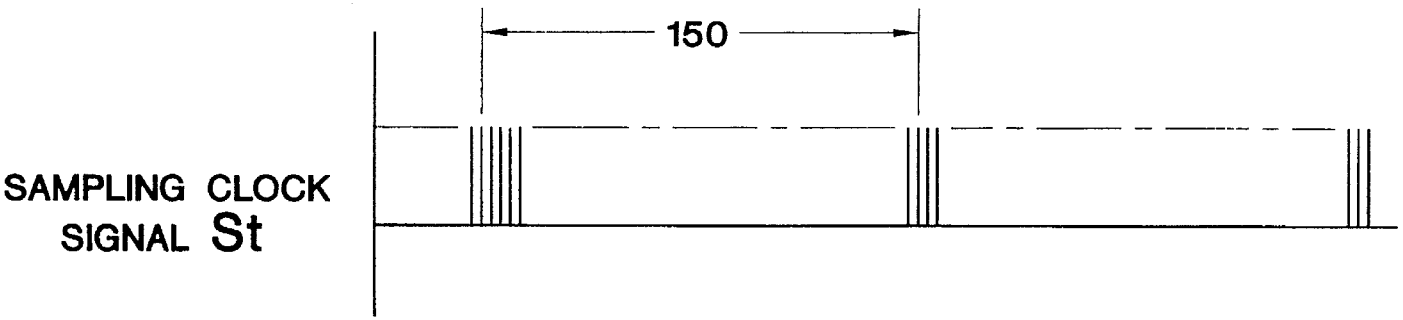

In this embodiment, n is set at 5. As shown in FIGS. 15A and 15B, therefore, the sampling clock signal St has 150 pulses for each cycle of the synchronizing clock signal Sc or each cigarette.

Figure 16:
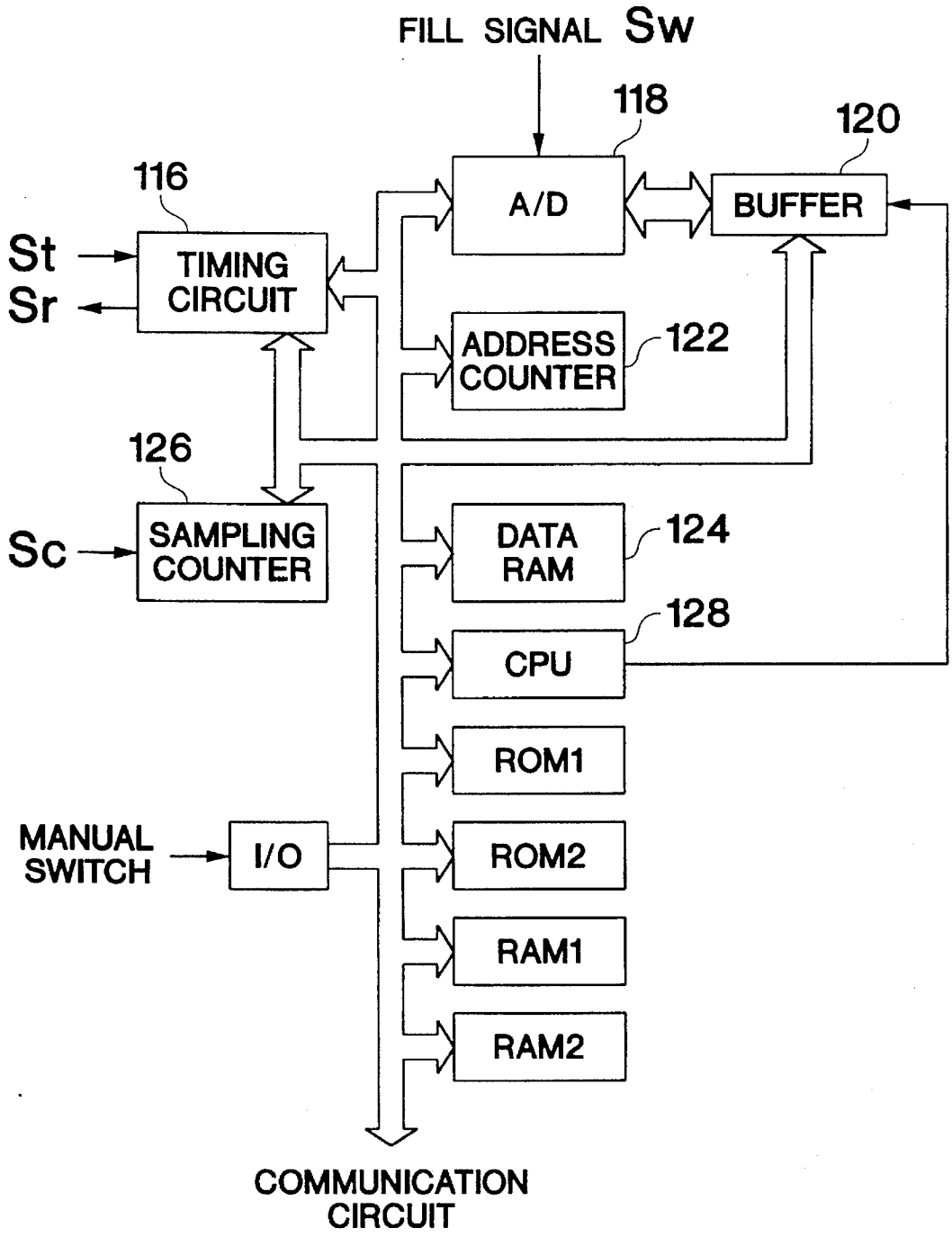
FIG. 16 is a block diagram showing an enrollment control section of FIG. 12.

As shown in FIG. 16, the enrollment control section 104 includes a timing circuit 116 to be supplied with the sampling clock signal St, an A/D converter 118 which receives the fill signal Sw, a buffer 120, an address counter 122, a data RAM 124, a sampling counter 126 to be supplied with the synchronizing clock signal Sc, etc. These elements are connected to one another by means of a bus.

The bus is connected with a communication circuit 130 (see FIG. 12) to which the communication line 48 is connected, as well as with a CPU 128, ROM1, ROM2, RAM1, and RAM2. In FIG. 12, the ROMs and RAMs are illustrated en bloc, respectively.

The enrollment control section 104 loads the data RAM 124 with data corresponding to the fill signal Sw by the direct memory access method, substantially independently of the CPU 128.

Figure 17:
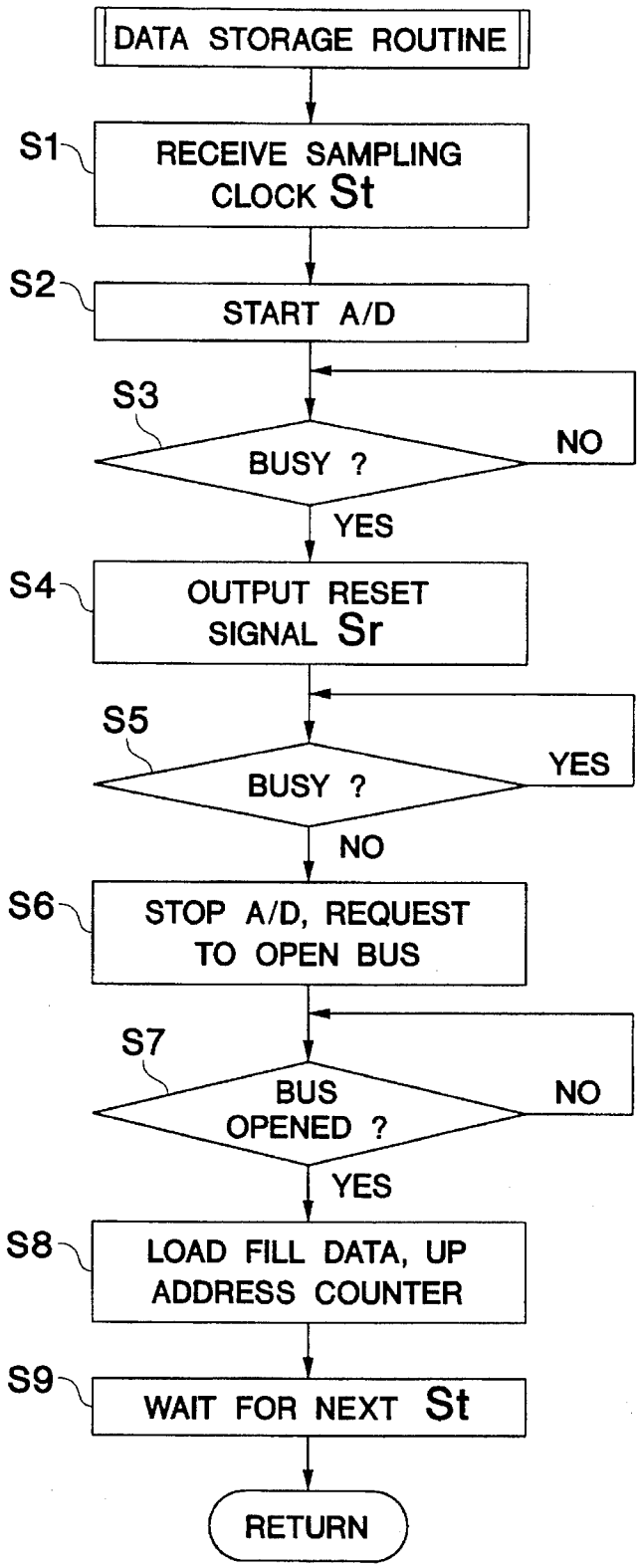
FIG. 17 is a flow chart showing a data storage routine in which the enrollment control section of FIG. 16 loads a data RAM with measurement date by a direct memory access method.

FIG. 17 shows a data storage routine executed in the enrollment control section 104. The following is a description of this routine.

Data Storage Routine

When one of the pulses of the sampling clock signal St is applied to the input of the timing circuit 116 (Step S1), the circuit 116 delivers a start signal to the A/D converter 118. In response to this start signal, the converter 118 supplies a busy signal to the timing circuit 116 for a fixed integral action period (Step S2). The integral action period is set within the interval between the pulses of the sampling clock signal St.

The timing circuit 116 delivers the reset signal Sr to the integrator 100, thereby opening the switches 103 of the integrator 100, while it is receiving the busy signal, that is, as long as the decision in Step S3 is YES (Step S4). At this point of time, integration of the detection signal Sd is started, and the fill signal Sw, indicative of the result of the integration, is supplied to the A/D converter 118. In the converter 118, the analog fill signal Sw is converted into digital fill data.

When the integral action period terminates, the busy signal cease to be supplied from the A/D converter 118 to the timing circuit 116, whereupon the circuit 116 closes the switches 103. As a result, the operation of the integrator 100 or the A/D converter 118 is stopped (Step S5). Thereafter, the timing circuit 116 delivers a request signal for opening the bus to the CPU 128 (Step S6).

When the timing circuit 116 receives a ready signal from the CPU 128 (Step S7), the fill datum from the A/D converter 118 is loaded into the data RAM 124 through the buffer 120. The storage position of the fill datum is settled depending on the address in the address counter 122 (Step S8). When the fill datum loading is finished, the address of the counter 122 is incremented.

In the next step or Step S9, delivery of the next sampling clock signal St is awaited.

Figure 18:
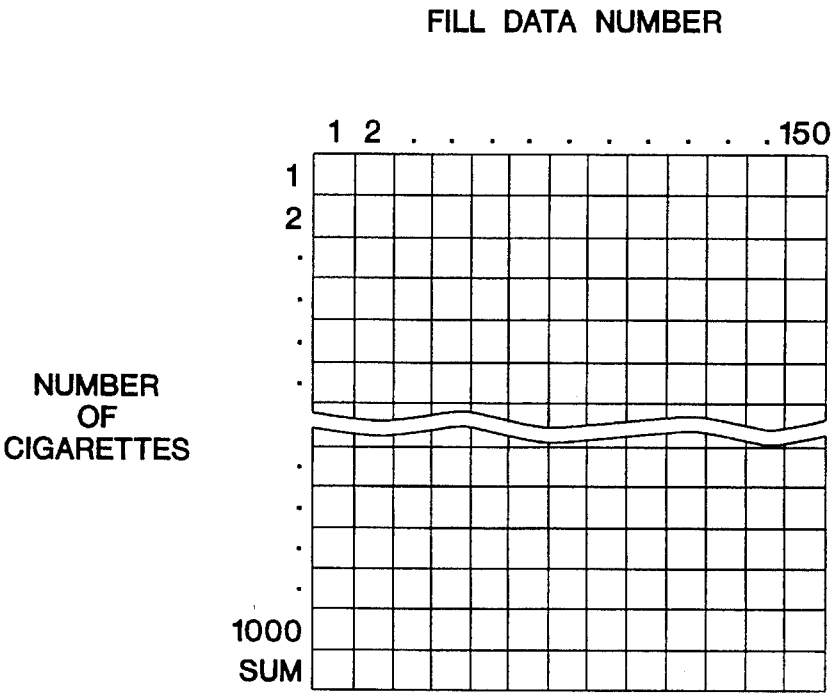
FIG. 18 is a diagram showing storage addresses in the data RAM for measurement data.

When the data storage routine described above is executed repeatedly, the fill data are successively loaded into the data RAM 124, as shown in FIG. 18. Since the sampling clock signal St has 150 pulses for each cigarette, as mentioned before, each fill data represents the cut tobacco fill for each of division obtained by dividing one cigarette into 150 equal parts.

A program for carrying out the data storage routine of FIG. 17 is stored in the ROM1, and is executed after it is loaded from the ROM1 to the RAM1. The RAM2 is a nonvolatile spare memory.

Figure 19:
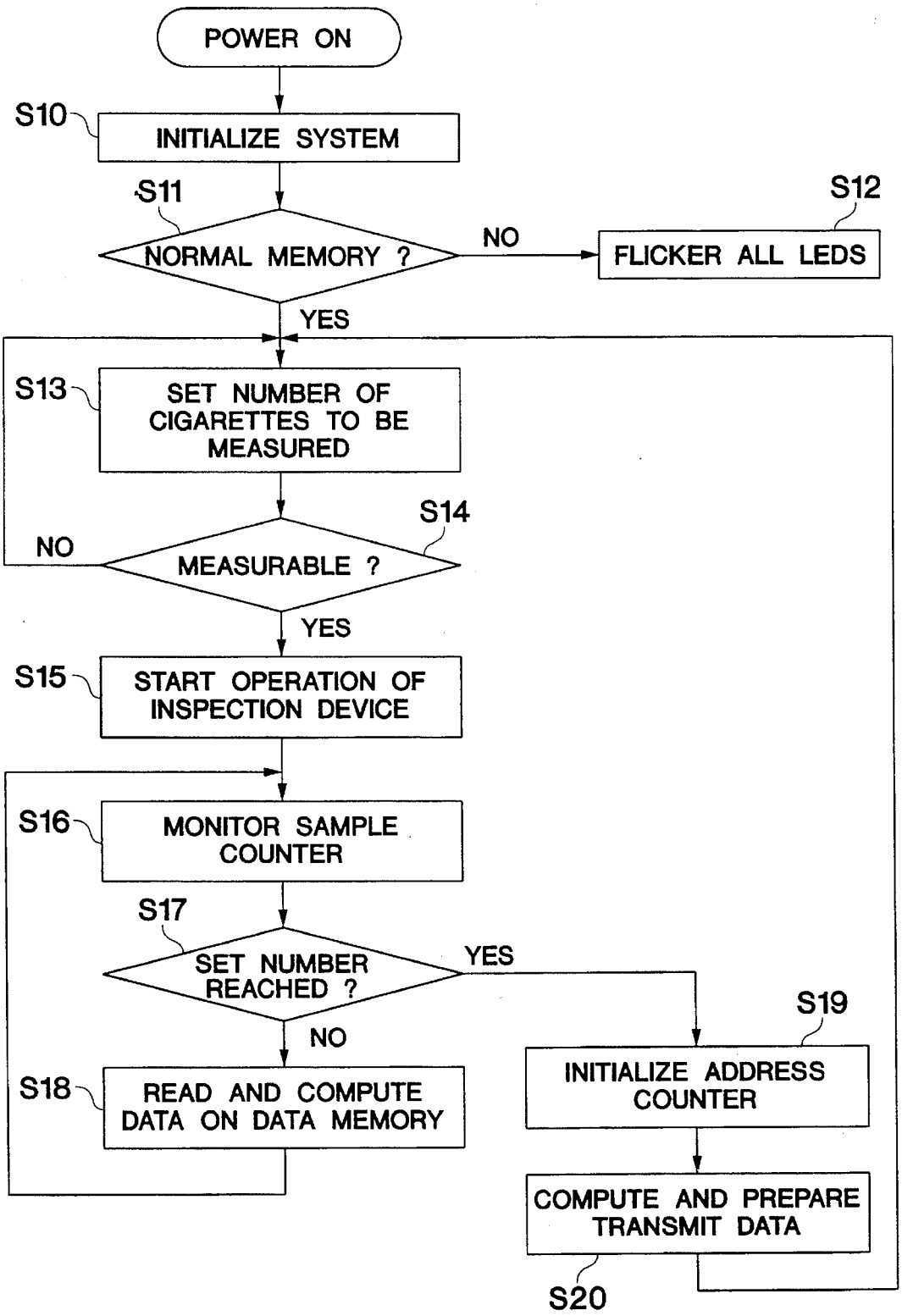
FIG. 19 is a flow chart showing a main routine executed by a CPU in the enrollment control section.

The ROM2 is stored with a main routine for controlling the operation of the inspection device 46. FIG. 19 shows the details of the main routine. The following is a description of this main routine.

Main Routine

First, a memory of the inspection device 46 is initialized, and besides, the program is loaded from the ROM1 to the RAM1 (Step S10). Then, the memory is checked (Step S11). If the memory is in trouble, all of light emitting diodes (not shown) of the inspection device 46 flicker (Step S12), for example, thereby informing an operator of the trouble.

If the memory is normal, the number of fill data to be stored in the data RAM 124, that is, the number of cigarettes as objects of inspection, is set in accordance with a set signal from a manual switch (Step S13). In this embodiment, the set number is 1,000.

Then, it is determined whether or not the fill data can be measured, that is, whether or not the operation of the cigarette manufacturing machine is stable (Step S14). If the decision in this step is NO, the program returns to Step S13. The data storage routine of the inspection device 46 starts only when the decision in Step S14 is YES (Step S15).

The CPU 128 examines the value in the sampling counter 126 (Step S16), and determines whether or not the set number is reached by the counter value (Step S17). More specifically, the value in the counter 126 is incremented by one every time the synchronizing clock signal Sc is supplied. Thus, the value in the sampling counter 126 represents the number of inspected cigarettes.

If the decision in Step S17 is NO, the CPU 128 proceeds to Step S16 via Step S18, whereupon it repeatedly executes the processes of Step S16 and the subsequent steps.

In Step S18, the CPU 128 calculates the total value of the fill data for corresponding divisions for the cigarettes having so far been measured, and loads the results of the calculation successively into a predetermined address of the data RAM 124. This address is designated by SUM in FIG. 18.

When the decision in Step S17 is YES, the CPU 128 initializes the address counter 122 (Step S19). Then, the CPU 128 computes the average of the fill data for the individual divisions stored in the data RAM 124, that is, average fill data for the divisions of 1,000 cigarettes, and prepares the computation result as transmit data (Step S20).

Thereafter, the CPU 128 repeatedly executes the process of Step S13 and the subsequent steps. Thus, up-to-date transmit data is prepared every time the process of Step S20 is executed.

Figure 20:
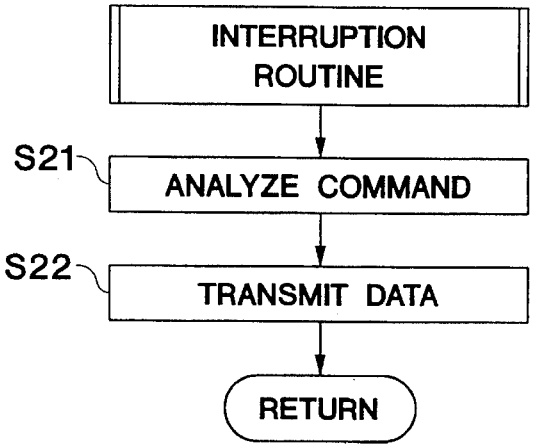
FIG. 20 is a flow chart showing an interruption routine in the main routine of FIG. 19.

On receiving an interruption signal from the server computer 50, on the other hand, the CPU 128 executes an interruption routine shown in FIG. 20.

Interruption Routine

In the interruption routine, analysis of a command which is indicated by the received interruption signal is first executed. For simplicity of illustration, however, the interruption signal here is supposed to be a transmit command for a request for data transmission (Step S21). On receiving the transmit command, the CPU 128 transmits prepared transmit data to the server computer 50 through the communication circuit 130 and the communication line 48 (Step S22), whereupon the interruption routine is finished.

The interruption signal from the server computer 50 is generated periodically in the computer 50 or when the touch panel 56 is operated by the operator.

Figure 21:
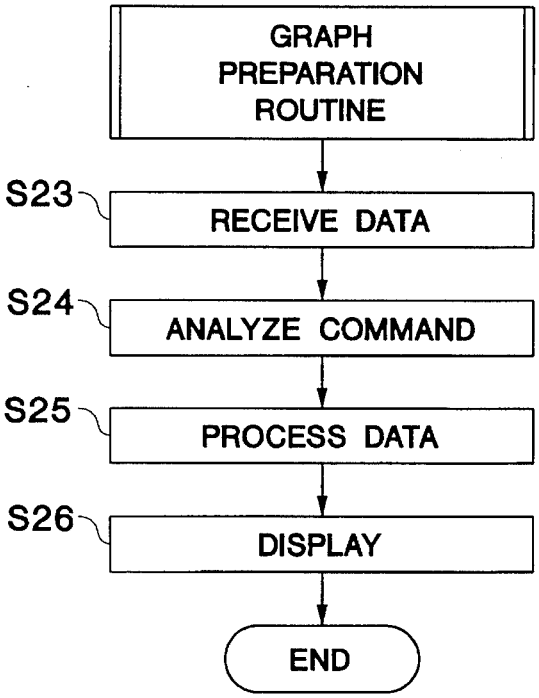
FIG. 21 is a flow chart showing a graph preparation routine executed by the server computer after the execution of the interruption routine of FIG. 20.

When the interruption signal is transmitted to the CPU 128 of the inspection device 46, the server computer 50 executes a graph preparation routine shown in FIG. 21.

Graph Preparation Routine

In the graph preparation routine, the data transmitted from the CPU 128 is first received (Step S23), and the command indicated by the interruption signal is analyzed (Step S24). In the server computer 50, in this case, the interruption signal is analyzed as a command which requests graphic display, data processing for the graphic display is executed in accordance with the received data (Step S25), and the result of the data processing is displayed as quality data on the CRT 52 (or printer 54) (Step S26).

In this embodiment, the quality data displayed on the CRT 52 is the average fill data for the individual divisions of cigarettes.

Figure 22:
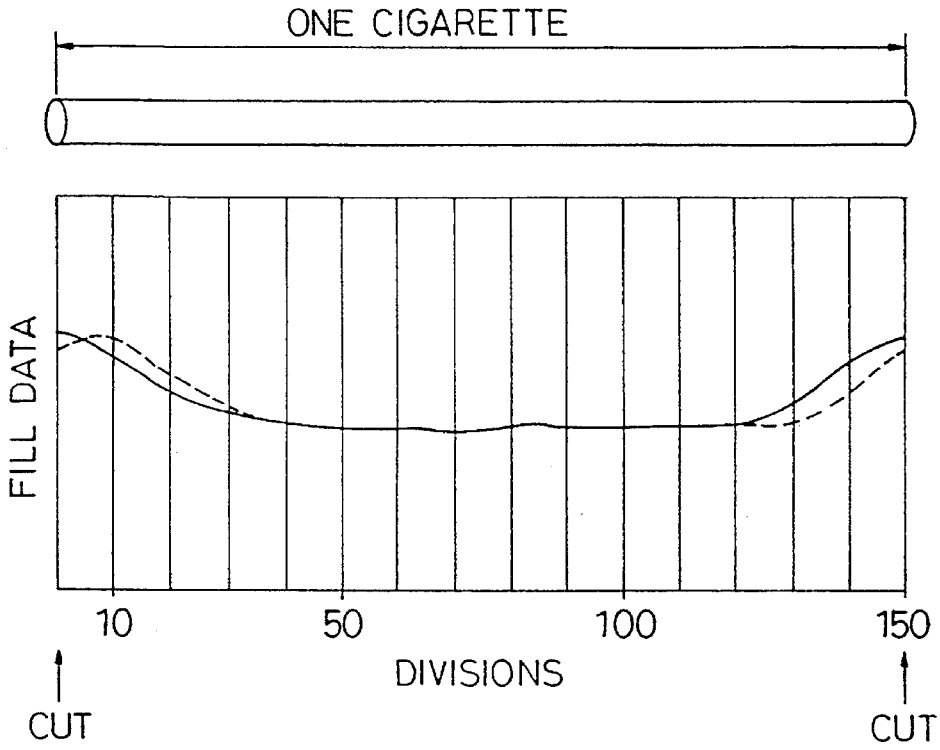
FIG. 22 is a diagram showing the distribution of the measurement data displayed on a CRT in the graph preparation routine of FIG. 21.

As is evident from the above description, the characteristic which is indicative of the distribution of the cut tobacco fill for cigarettes may be such as the one represented by a full-line curve in FIG. 22 if the cigarette rod TR is cut accurately in the center of each high-density portion 28, that is, if the rotational phase of the trimming disks is adjusted accurately to the cutting timing. In the case of the full-line characteristic curve, the average fill data takes its highest value at each end portion.

If the distribution characteristic is represented by a broken-line curve in FIG. 22 such that its highest-value portions for the average fill data are shifted from those of the full-line curve, however, the operator can conclude that the rotational phase of the trimming disks is deviated from cutting timing without requiring any skill, and can quickly adjust the rotational phase of the disks. In consequence, the incidence of defectives such that the cut tobacco falls off from the cut ends of the cigarettes is lowered considerably, and besides, the fills of the cut tobacco in the individual filter cigarettes can be kept uniform.

Thus, each cigarette is further cut into a pair of cigarette portions, which are used to form filter cigarettes, so that a difference is caused between the respective tobacco fills of the cigarette portions unless the rotational phase of the trimming disks is adjusted accurately to the cutting timing. This difference can be easily detected from the graph displayed on the CRT 52.

The number of the average fill data transmitted from the inspection device 48, that is, the number of the divisions for each cigarette, is fixed even though the rod speed of the cigarette rod TR varies. Thus, the distribution of the average fill data displayed on the CRT 52 accurately represents the fill of the cut tobacco in each cigarette.

The operator can display the average fill data distribution on the CRT 52 on a real-time basis by only operating the touch panel 56. Accordingly, the operator can carry out the aforesaid inspection at any desired point in time, and therefore, can considerably save himself labor for quality control.

In the inspection device 46, moreover, the fill data are loaded successively into the data RAM 124 by the direction memory access method, so that plenty of data can be stored in a short period of time. Accordingly, the CPU 128 can be released from the work of storing the fill data, and can compute the average fill data for each division in a short period of time.

When the average fill data for each division is thus calculated on the inspection device side, the load on the server computer 50 is also reduced. On receiving the data from the inspection device 46, therefore, the computer 50 can display the average fill data distribution for each cigarette on the CRT 52.

Thus, the server computer 50 can also process the data from the aforementioned other devices in a parallel or time sharing mode, without being engaged in preparing the average fill data distribution for a long period of time.

It is to be understood that the present invention is not limited to the embodiment described above, and that various changes and modifications may be effected therein by one skilled in the art without departing from the scope or spirit of the invention. For example, the inspection device 46 may be arranged so as to be able to supply the transmit data to the server computer 50 every time the process of Step S20 of the main routine shown in FIG. 19 is executed.

Figure 23:
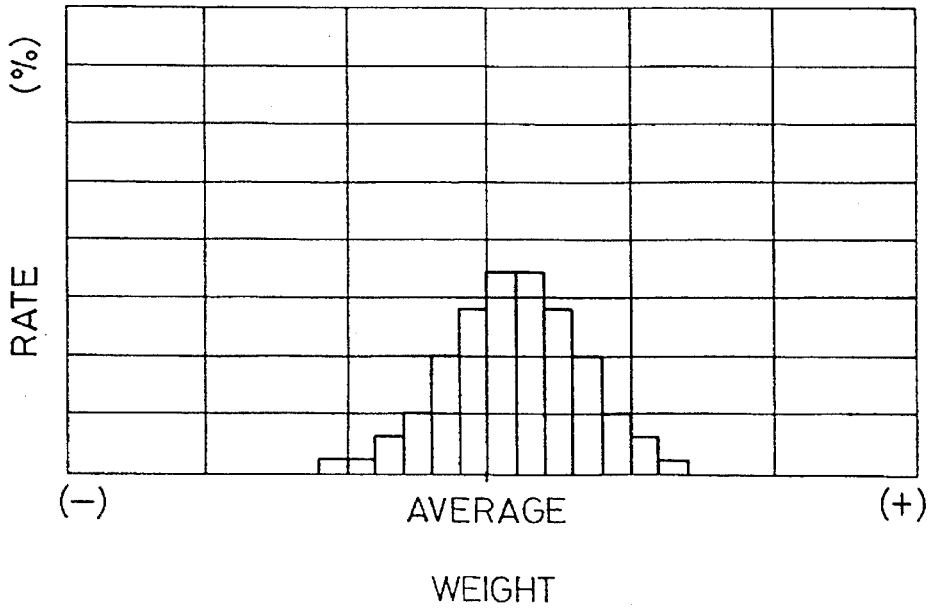
FIG. 23 is a graph for quality control displayed on the CRT on the basis of the measurement data of FIG. 22.

In this case, the server computer 50 can monitor the transition of the average fill data distribution for each day on the basis of received data accumulated in succession, and cause the printer 54 to print the resulting report. Also, the computer 50 can calculate the cut tobacco fill or weight for each entire cigarette in accordance with the distribution of the individual received data or average fill data. As shown in FIG. 23, moreover, the computer 50 can prepare and display the cigarette weight distribution for each day.

What is claimed is:

1. A system for monitoring a quantity of cut tobacco in cigarettes manufactured by means of a cigarette manufacturing machine, which forms a continuous cigarette rod traveling at a predetermined speed and cuts the formed cigarette rod into individual cigarettes with a predetermined length, said system comprising:

(a) an inspection device including:

(i) first detecting means for continuously detecting a filling density of cut tobacco in the cigarette rod and outputting a detection signal while the cigarette rod is traveling;

(ii) calculating means for continuously calculating a fill of the cut tobacco in each of a predetermined number of equal divisions of a region of the cigarette rod which corresponds to each cigarette, in accordance with the detection signal from said detecting means, and outputting calculation data;

(iii) data storage means for repeatedly enrolling the calculating data from said calculating means in a quantity corresponding to a predetermined number of cigarettes at a time; and (iv) arithmetic means for computing average calculation data for each division of the manufactured cigarettes in accordance with the calculation data enrolled by said data storage means and outputting the result of the computation; and (b) a data management device including:

(i) data originating means for receiving the computation result and originating quality data for the cut tobacco fill for each manufactured cigarette in accordance with the received computation result; and (ii) display means for displaying the originated quality data;

said data management device connected to said inspection device by a communication line;

said calculating means includes second detecting means for detecting a traveling speed of the formed cigarette rod, first signal generating means for repeatedly generating cutting timing signals of the cigarette rod in accordance with the detected rod speed, second signal generating means for generating division signals defined by a given number of pulses in intervals between the timing signals, and integrating means for integrating the detection signal from said first detecting means, said integrating means integrating the detection signal for a given period of time within the division signals from said second signal generating means and outputting the result of the integration as the calculation data.

2. A system according to claim 1, wherein said data management device further includes a console for generating a command signal to request transmission of the computation result obtained by means of said arithmetic means, the command signal being supplied to said arithmetic means through the communication line.

3. A system according to claim 2, wherein said data management device is connected, by means of the communication line, to various control devices for controlling and examining the operation of the cigarette manufacturing machine and various control devices for controlling and examining the operation of a filter attachment for fabricating filter cigarettes from the manufactured cigarettes, and receives data from the control devices.

4. A system according to claim 1, wherein said second signal generating means includes a signal processing circuit for generating second pulses fewer than said first pulses, in the intervals between the cutting timing signals, and a multiplication circuit for multiplying the number of the second pulses from the signal processing circuit to said given number.

5. A system according to claim 1, wherein said data storage means includes a memory device for storing data and a transfer device for transferring the calculation data to the memory device by a direct memory access.

6. A system according to claim 1, wherein said display means includes a CRT display, and said data originating means graphs the quality data for cigarettes on the basis of cutting positions of the cigarette rod settled in accordance with the cutting timing signals and displays the quality data on the CRT display.

7. A system according to claim 1, wherein said display means further includes a printer for printing the quality data.

* * * * *